US005805951A

United States Patent [19]

Kato et al.

[11] Patent Number: 5,805,951

[45] Date of Patent: Sep. 8, 1998

[54] IMAGE FORMING APPARATUS DETECTING USEFUL LIFE OF AN IMAGE BEARING MEMBER

[75] Inventors: Junichi Kato, Toride; Satoru Inami, Kashiwa; Jun Suzuki, Numazu; Atsutoshi Ando, Kashiwa, all of Japan

[73] Assignee: Canon Kabushiki Kaisha, Tokyo, Japan

[21] Appl. No.: 590,438

[22] Filed: Jan. 23, 1996

[30] Foreign Application Priority Data

Jan. 23, 1995 [JP] Japan ..... 7-008361

[51] Int. Cl.[6] ..... G03G 21/00

[52] U.S. Cl. ..... 399/26; 399/48; 399/169

[58] Field of Search ..... 399/26, 48, 50, 399/73, 169, 176

[56] References Cited

U.S. PATENT DOCUMENTS

| | | | |
|---|---|---|---|
| 4,284,344 | 8/1981 | Okamoto et al. | 399/51 |
| 5,072,258 | 12/1991 | Harada | 399/50 |
| 5,160,967 | 11/1992 | Tonegawa | 399/26 |
| 5,278,612 | 1/1994 | Inui | 399/26 |
| 5,485,248 | 1/1996 | Yano et al. | 399/73 |
| 5,548,380 | 8/1996 | Naka et al. | 399/176 |

FOREIGN PATENT DOCUMENTS

| | | |
|---|---|---|
| 63-133166 | 6/1988 | Japan . |
| 1-66669 | 3/1989 | Japan . |

*Primary Examiner*—Fred L. Braun
*Attorney, Agent, or Firm*—Fitzpatrick, Cella, Harper & Scinto

[57] ABSTRACT

An image forming apparatus for detecting the useful life of an image bearing member includes an image bearing member; a charging member contactable to the image bearing member for charging the image bearing member, the charging member being supplied with a voltage. The image forming apparatus also includes a discharging member for electrically discharging the image bearing member, the discharging member discharging a first region of the image bearing member and a second region of the image bearing member, different from the first region in a direction of a generating line of the image bearing member; and a detecting device for detecting a current flowing through the charging member when the charging member is supplied with a predetermined voltage and charges the first region having been discharged by the discharging member and when the charging member also charges the second region having been discharged by the discharging member.

14 Claims, 5 Drawing Sheets

IMAGE FORMING APPARATUS DETECTING USEFUL LIFE OF AN IMAGE BEARING MEMBER

FIELD OF THE INVENTION AND RELATED ART

The present invention relates to an image forming apparatus such as an electro-photographic apparatus, for example, a copying machine, a laser printer, or the like.

In contact charging, the surface of a photosensitive member is charged to a predetermined potential level by means of placing a charging member to which voltage is applied, in contact with the photosensitive member as an image bearing member, so that electrical charge is directly transferred to the photosensitive member. The contact type charging apparatus is superior to the corona discharging type charging apparatus which has been widely employed as the charging apparatus, in that the voltage necessary to be applied to charge the photosensitive member surface to the predetermined potential level can be reduced; the amount of the ozone generated during the charging process is extremely small, making it possible to eliminate the need for an ozone removal filter or the like, and therefore, making it possible to simplify the exhaust system structure of the apparatus; it is maintenance free; and the structure thereof is simple.

Therefore, the contact type charging apparatus as means for charging the photosensitive member of the electro-photographic apparatus (copying machine, laser beam printer, or the like), or the image bearing member, such as the dielectric member or the like, of the electrostatic recording apparatus, has been attracting attention as the charging means capable of replacing the corona discharging type charging apparatus. It also has been put to practical use.

Regarding the contact type charging apparatus, the system disclosed in Japanese Laid-Open Patent Application No. 149,669/1988 is known, in which, in order to obtain uniform charge, an oscillating voltage composed of a DC component and an AC voltage superposed thereon is applied to a contact type charging member which is in contact with the photosensitive member.

FIG. 7 depicts an embodiment of the present invention. In the drawing, a reference numeral 1 designates a photosensitive member, for example, an electro-photographic photosensitive member, a dielectric member for electrostatic recording, or the like. It is in the form of a drum (hereinafter, referred to as "photosensitive drum"), and is rotated, for example, in the direction of an arrow mark A (clockwise), at a predetermined peripheral velocity (process speed).

A reference numeral 2 designates a charge roller as the contact type charging member. It comprises a metallic core 2*a*, and an electrically conductive layer 2*b*, such as a layer of electrically conductive rubber or the like, which covers the peripheral surface of the metallic core 2*a*. It is placed in contact with the photosensitive drum 1, with a predetermined amount of contact pressure generated by compression springs 21 which press corresponding ends of the metallic core 2*a*. It is rotated by the rotation of the photosensitive drum 1.

A reference numeral 6 designates a power source for applying voltage to the charge roller 2. The superimposed voltage, that is, a voltage ($V_{ac}$+$V_{dc}$) composed of an oscillating voltage $V_{ac}$ having a peak-to-peak voltage $V_{pp}$ no less than twice the charge starting voltage of the photosensitive member 1 and a DC voltage $V_{dc}$, is applied to the charge roller 2 to uniformly charge the peripheral surface of the photosensitive drum 1 being rotatively driven.

When the charge roller 2 described above is employed, the following problems occur.

In the case of the charge roller 2 used in contact charging, the base layer 2*b* is normally covered with plural surface layers in order to prevent the leak through the pin holes of the photosensitive drum 1, or in order to prevent the charge roller 2 from sticking to the surface of the photosensitive drum 1. Generally speaking, these surface layers are formed by coating the base layer 2*b* with the surface layer material in liquid form, in consideration of productivity, cost, and the like. However, according to widely accepted opinion, it is rather difficult to control the thickness of the surface layers, that is, it is rather difficult to form even surf ac e layers within the approximately 10 mm wide end regions of the charging roller 2 in the longitudinal direction of the charging roller 1. This is because when the base layer 2*b* is coated, the coating material tends to drip distribute unevenly or be haves likewise . Therefore, in the case of a conventional charge roller, the unevenness of the coating on the end portions which are not involved in charging the image formation region (region to be used for forming an image) of the photosensitive drum 1 is rather large.

In recent years, as the size of the electro-photographic image forming apparatus employed in a personal printer or the like has been reduced, it has become necessary to create a design that utilizes the entire length, of the photo-sensitive drum 1 or the charge roller 2 as the image formation region, that is, the image formation region must be extended to the very ends of the photosensitive drum 1 or the charging member 2. Consequently, various problems as described below occur in the end regions of the aforementioned charge roller, where the thickness of the coat is uneven.

First, when the degree of unevenness in the thickness of the leak prevention high resistance layer is substantial, the current flow is concentrated in the area where the coat is relatively thin. As a result, the surface of the photosensitive drum 1 correspondent to this current concentrated area is aggressively deteriorated by electrical discharge. Consequently, the surface of the end portions of the photosensitive drum 1, which comes in contact with the end portions of the charge roller, become liable to be shaved away much more than the other portions, and in extreme cases, the photosensitive layer is peeled off, allowing a leak to occur.

Further, deformation such as swelling occurs at the end portions of the charge roller, and, as a result, the electrical discharge which occurs across the micro-gap between the deformed portion of the charging member and the photosensitive drum 1 becomes larger than that across the micro-gaps correspondent to the other portions of the charge roller. Consequently, the portion of the surface of the photosensitive drum 1 correspondent to the region where the aforementioned phenomenon occurs becomes liable to deteriorate more than the other portions, and when these portions are rubbed by a cleaning blade or the like in the same manner as the other portions are rubbed, it is shaved by a substantial amount.

Further, the compression springs 21 press the correspondent end portions of the charge roller 2 toward the photosensitive drum 1, pressing thereby the charge roller 2 onto the photosensitive drum 1. Therefore, the charger roller 2 bows in the direction perpendicular to the longitudinal direction thereof, rendering the contact pressure between itself and the photosensitive drum 1 larger at the end portions than at the middle portion, which in turn is liable to cause the mechanical shaving thereon. In addition, generally speaking, the thickness of the photosensitive layer of the photosensitive drum 1 is not as uniform at the end portions as it is at the middle portion thereof, and also is thinner at the end portions where the photosensitive layer begins on the drum ends, which is another essential factor contributing to the drum end shaving.

Further, it is more likely than not that the end portions of the charge roller 2 make contact with the photosensitive drum 1, at portions where the photosensitive layer begins. This occurs because of the current trend in the design of the photosensitive drum 1 or the charge roller; the length of the photosensitive member 1 or the charge member must be reduced to the point at which the image formation region covers practically the entire length thereof.

Because of the synergistic effects of the aforementioned factors, the photosensitive drum wears excessively at the end portions, and as it wears, the electrical resistance decreases, allowing the current flow to concentrate in the end portions, and therefore, making it impossible to uniformly charge the photosensitive drum 1 across its entire length. As a result, fog or the like occurs.

When the photosensitive drum deteriorates to the aforementioned stage, it must, be replaced as soon as possible.

In the past, an extremely complex procedure had to be performed in order to replace expendable components such as the photosensitive drum 1. In recent years, however, the photosensitive drum 1 and a development device have come to be integrally incorporated as a unit, that is, a process cartridge 1, rendering it simpler to exchange the expendable components.

However, the electro-photographic apparatus employing integrated unit comprising the photosensitive drum 1 and the development device has its own problem in that as the development agent (toner) within the development device is depleted, the unit must be replaced with a fresh unit even when the service life of the photosensitive drum 1 or the development device has not expired.

As means for solving this problem, a system is conceivable in which the toner depleted unit can be replenished with fresh toner instead of being discarded. In the case of such a unit, the unit is replaced when the service life of either the photosensitive drum 1 or the development device has expired; therefore, the toner replenished immediately before the service life of one the components expires will be wasted, which also creates a problem.

SUMMARY OF THE INVENTION

Accordingly, the primary object of the present invention is to provide an image forming apparatus capable of accurately predicting the expiration Liming of the image bearing member service life.

According to an aspect of the present invention, an image forming apparatus is capable of detecting the difference in the amount of shaving which occurs across the image bearing member in the direction perpendicular to the generatrix of the image bearing member.

Another object of the present invention is to provide an image forming apparatus capable of preventing certain areas of the image bearing member surface from failing to be charged because of the charge leak caused by the shaving of the image bearing member.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the drawings.

Embodiment 1

Figure 1:
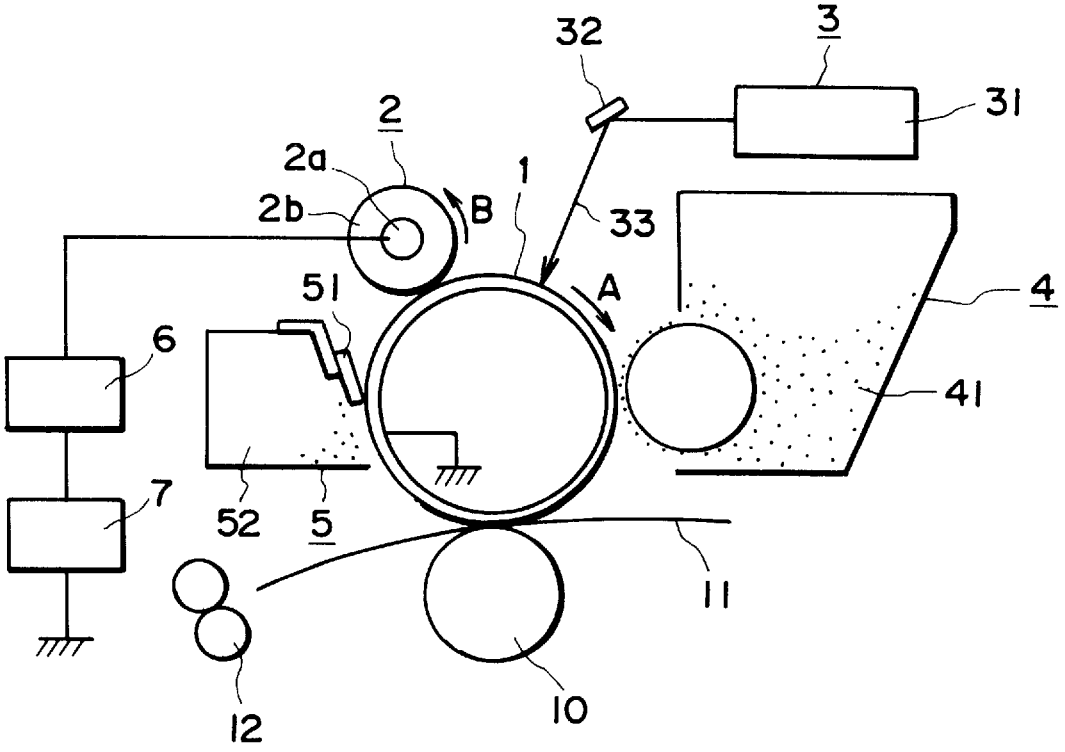
FIG. 1 is a longitudinal section of the image forming apparatus in the first embodiment of the present invention, depicting the general structure thereof.

FIG. 1 is a schematic longitudinal section of the image forming apparatus in accordance with the present invention, which comprises an apparatus for detecting the residual service life of the photosensitive member. First, the general structure of the image forming apparatus will be described with reference to the drawing.

This image forming apparatus comprises an electrophotographic photosensitive member 1 (photosensitive drum) as the image bearing member in the form of a drum. The photosensitive drum 1 comprises an aluminum cylinder as a drum base, which is 30 mm in diameter and 260 mm in length, and a photosensitive layer. The photosensitive layer comprises a charge generation layer (CGL) formed on the drum base, and a charge transfer layer (CTL) laminated on the charge generation layer.

As for the CGL, ten parts of copper (II) phthalocyanine pigment and ten parts of polyvinyl butyral resin are mixed in 120 parts of cyclohexanone, being allowed to disperse for ten hours, using a sand mill apparatus. Then, 30 parts of methyl-ethyl ketone are added to the solution. The thus obtained solution is coated on the peripheral surface of the drum base to a thickness of 0.15 $\mu$m.

As for the CTL, ten parts of polycarbonate resin, the average molecular weight of which is 120,000, is dissolved, along with 10 parts of hydrazone compound, into 80 parts of monochlorbenzene, and the thus obtained solution is coated on the CGL to a thickness of 16 $\mu$m to form the CTL.

The photosensitive drum 1 is rotatively driven in the arrow A direction at a peripheral velocity (processing speed) of 50 mm/sec.

The charge roller 2 as the contact type charging member is placed in contact with the surface of the photosensitive member 1. It comprises a metallic core 2*a*, and a base layer 2*b* covering the metallic core 2*a*. This base layer 2*b* may be constituted of an electrically conductive rubber layer, or the like, composed of rubber material such as EPDM, and carbon dispersed therein. To the metallic core, a DC voltage, as the bias voltage, of −1.3 kV is applied from a bias power source 6. The bias power source 6 is grounded through a charging current detecting means 7 connected in series. The charge roller 2 is placed directly in contact with the surface of the photosensitive drum 1, and is rotated in the direction of an arrow B by the photosensitive drum 1 which is rotated in the direction of the arrow A. As the charge roller 2 is rotated as described above, with the aforementioned bias being applied thereto, it uniformly charges the surface of the photosensitive drum 1 to a predetermined potential level, that is, approximately −700 V.

The uniformly charged photosensitive drum 1 is exposed to a light beam projected from an exposure apparatus 3, whereby an electrostatic latent image is formed on the Photosensitive drum 1. The exposure apparatus 3 is constituted of an optical system unit 31 which comprises a light source, a polygon mirror, a deflection mirror 32, and the like. The light source is a semiconductor laser or the like. The laser beam emitted from the light source is deflected by the deflection mirror 32, and the deflected laser beam is projected as an exposure light 33 onto the photosensitive drum 1, whereby an electrostatic latent image correspondent to imaging data is formed on the surface of the photosensitive drum 1.

The electrostatic latent image is developed into a toner image by a development apparatus 4; toner 41 having been triboelectrically charged to the negative polarity is adhered to the electrostatic latent image by the development apparatus 4.

the toner image formed on the photosensitive drum 1 is transferred onto the surface of a transfer material 11 which is delivered to a transfer station in synchronism with the toner image; the toner image is transferred using a transfer roller 10 (transfer apparatus) which applies to the back side of the transfer material 11, a predetermined level of electrical charge having the polarity opposite to that of the toner 41.

The transfer material 11, on the surface of which the transferred image yet to be fixed is borne, is delivered to a fixing means 12, in which the toner image is fixed. Thereafter, the transfer material 11 is discharged from the main assembly of the image forming apparatus. After the toner image transfer, the photosensitive drum 1 is cleared of the toner remaining on the surface thereof by the cleaning blade 51 of a cleaning apparatus 5, being readied for the following image formation. The residual toner removed from the photosensitive drum 1 is collected in the container portion of the cleaning apparatus 5.

While the image forming apparatus structured as described above is used for forming images, the photosensitive layer of the photosensitive drum 1 is rubbed by the charge roller 2, the transfer material 11, the cleaning blade 51, and the like. As a result, it is gradually worn (shaved away) throughout its service life.

Figure 2:
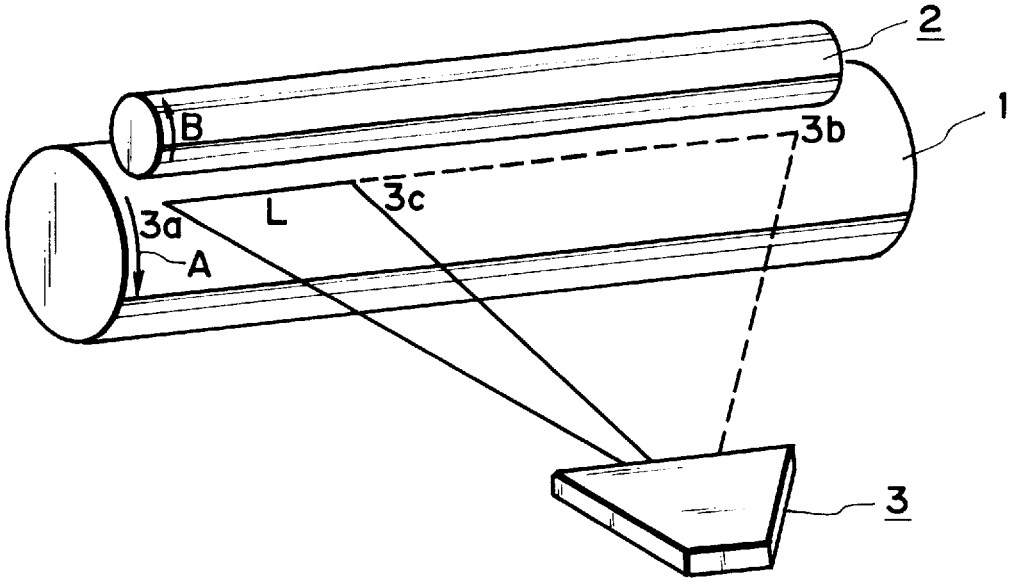
FIG. 2 is a perspective view of the photosensitive drum and its adjacencies in the first embodiment of the present invention, depicting the area to be exposed.
Figure 3:
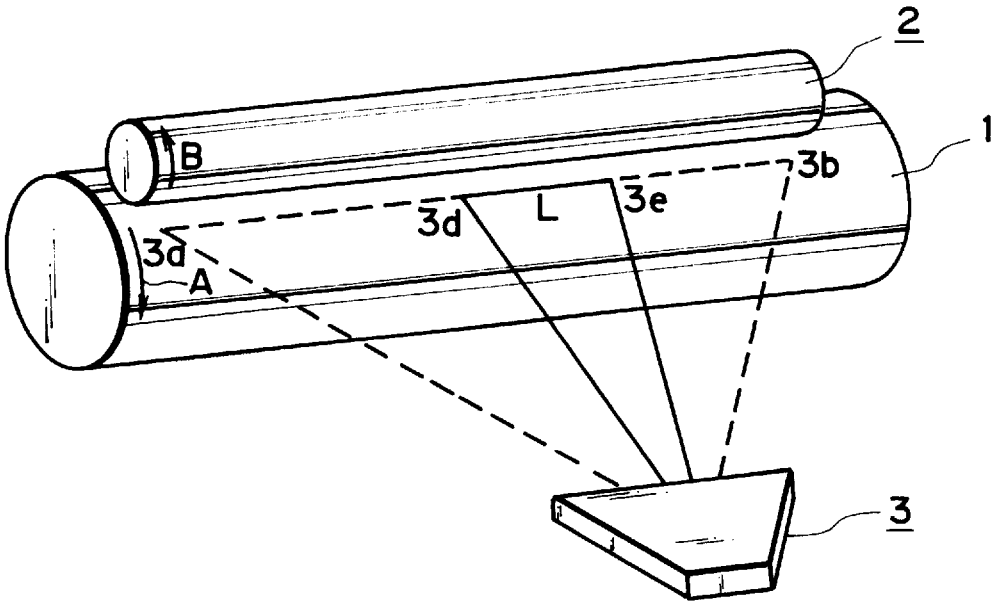
FIG. 3 is also a perspective view of the photosensitive drum and its adjacencies in the first embodiment of the present invention, depicting the area to be exposed.
Figure 4:
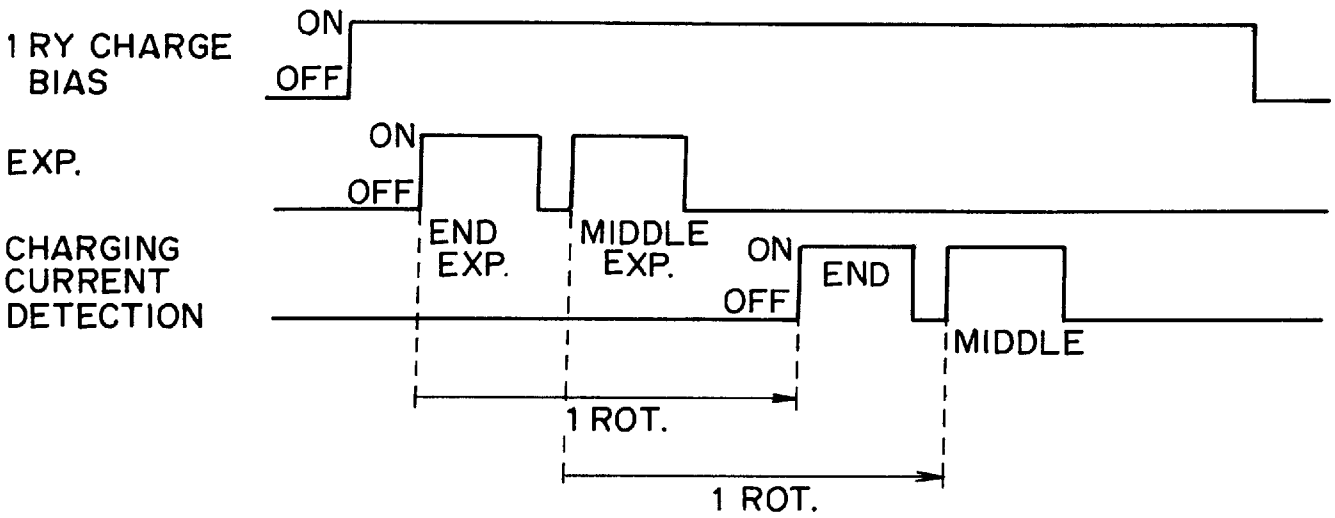
FIG. 4 shows the sequence for detecting the remaining service life of the photosensitive member in the first to fourth embodiments of the present invention.

Next, referring to FIGS. 2, 3 and 4, a method for detecting the thickness of the photosensitive layer of the photosensitive drum 1 will be described. FIGS. 2 and 3 depict the areas of the photosensitive drum 1, which are exposed to detect the thickness of the photosensitive layer at the end and middle portions in the direction parallel to the generatrix of the photosensitive drum 1. FIG. 4 is a timing chart for detecting the photosensitive layer thickness.

First, the primary bias is turned on to uniformly charge the surface of the photosensitive drum 1 to the negative polarity.

Then, the photosensitive drum 1 is exposed by the exposure apparatus 3 only on the end portion as shown in FIG. 2. More precisely, it is exposed only on the end portion with which the end portion of the charge roller 2 is in contact (region between points 3*a* and 3*b* in FIG. 2, which will be simply referred to as end portion, hereinafter). Next, the photosensitive drum 1 is exposed as shown in FIG. 3, that is, only on the middle portion with which the middle portion of the charge roller 2 is in contact (region between points 3*d* and 3*e* in FIG. 3, which will be simply referred to as middle portion, hereinafter). As a result, the surface potential level of the aforementioned exposed regions of the photosensitive drum 1 reach approximately −100 V. The widths of the exposed end and middle portions (width in the longitudinal direction of the photosensitive drum 1) are the same, and will be designated by a letter L. In this embodiment, L is 50 mm. More specifically, the terms "end" and "middle" are defined with reference to the longitudinal direction of the nip formed between the photosensitive drum 1 and the charge roller 2.

Next, with the primary bias remaining activated, the photosensitive drum 1 is further rotated to recharge the aforementioned exposed end and middle portions. During this period., the current flowing from the bias power source 6 to the photosensitive drum 1 through the charge roller 2 is detected by a charging current detecting means 7. It is preferable that a constant voltage control is executed on the charge roller 2. Designating the charge currents correspondent to the exposed end and middle portions by Ie and Ic, respectively:

$$I_e=(\epsilon_\tau \times \epsilon_O \times L \times V_p \times V)/d_e$$

$$I_c=(\epsilon_\tau \times \epsilon_O \times L \times V_p \times V)/d_c$$

In the above equations, $\epsilon_\tau$: dielectric constant $\epsilon_O$: dielectric constant in a vacuum state L: width of exposed portion in the longitudinal direction of the photosensitive drum $V_p$: process speed of photosensitive drum V: potential difference between exposed and charged portions $d_e$: thickness of end portion of photosensitive layer $d_c$: thickness of middle portion of photosensitive layer Thus, the thickness of the photosensitive layer of the photosensitive drum 1 at the end and middle portions can be known by measuring the charging currents $I_e$ and $I_c$. For example, when the photosensitive drum 1 had not been shaved (thickness of photosensitive layer: 16 μm), the charging currents at the end and middle portions were both −5 μA. As printing was continued using the aforementioned image forming apparatus, and the photosensitive layer began to be shaved away from the area correspondent to the end portion of the charge roller 2, a difference appeared between the charging currents Ie and Ic. After 5,000 prints, the photosensitive layer thickness was 8 μm at the end portion, and 10 μm at the middle portion. At that time, the correspondent charging currents were −10 μA and −8 μA, respectively, making it possible to detect the difference in the photosensitive layer thickness. After 6,000 prints, the thickness at the end portion dropped to no more than 6 μm, allowing the charging bias to leak. Therefore, it is reasonable to conclude that as the difference of the photosensitive layer thickness between the end and middle portions thereof in the direction of the generatrix of the photosensitive drum 1 increases, the more current is liable to be drawn toward the area where the photosensitive thickness is less, thereby causing the leak.

In other words, this embodiment makes it possible to detect the residual service life of the photosensitive member by detecting the difference in the photosensitive layer thickness between the end and middle portions, before the charging bias begins to leak as the photosensitive layer is gradually shaved from the portion correspondent to the end portion of the charge roller 2.

Further, according to this embodiment, whether the end portion of the photosensitive layer has been significantly shaved or not is determined by comparing the charging current at the end portion of the photosensitive member with the charging current at the middle portion; therefore, detection accuracy is improved.

It should be noted here that the amount of the charging current may be measured when the photosensitive drum 1 is used for the first time, and the thus obtained measurement may be recalled to be compared with the level of the charging current measured thereafter.

Further, in this embodiment, the charging bias was described as a DC voltage, but it may be superimposed voltage composed of a DC voltage, and an AC voltage superimposed thereon. In the case of the superimposed voltage, the charging current detecting means 7 is set up to detect the level of the DC voltage component.

Also in this embodiment, the exposure apparatus 3 was described as a scanning type optical system, but obviously, it may be constituted of an LED array, an LCD array, or the like Embodiment 2

In this embodiment, a process cartridge is employed in the image forming apparatus comprising the photosensitive member service life detection apparatus described in Embodiment 1.

Figure 5:
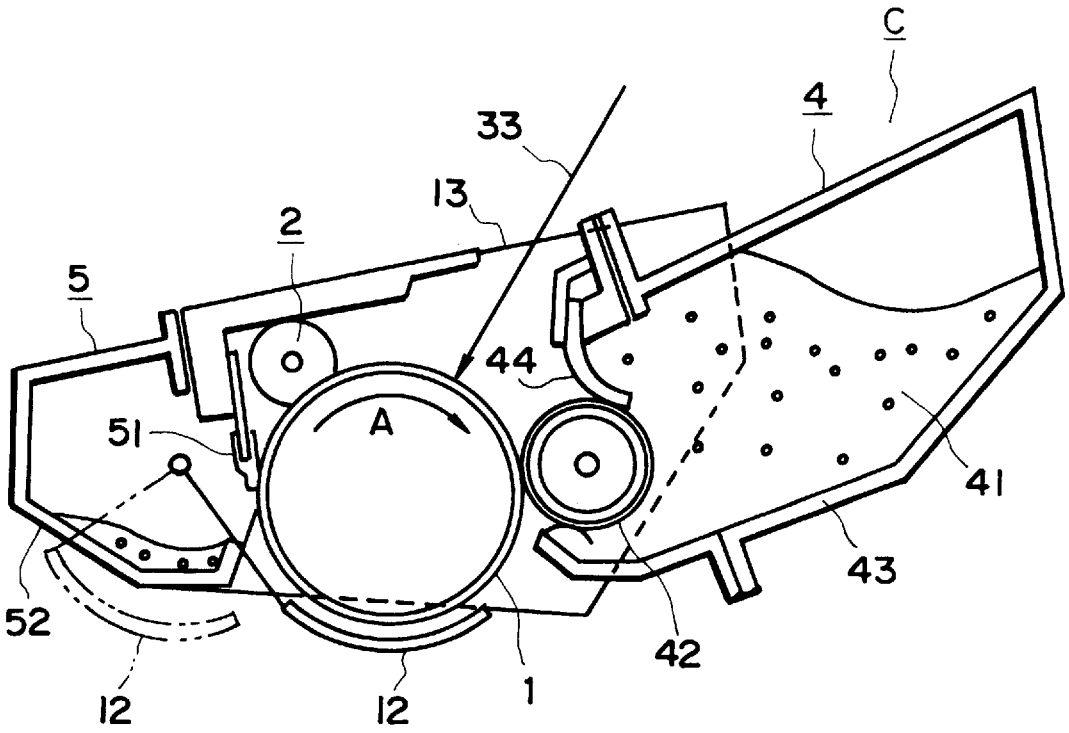
FIG. 5 is a longitudinal section of the process cartridge in the second embodiment of the present invention.

Referring to FIG. 5, the process cartridge In this embodiment comprises four processing devices: an electrophotographic photosensitive member 1 in the form of a drum (photosensitive drum) as the image bearing member; a charge roller 2 as the contact type charging member; a development apparatus 4; and a cleaning apparatus 5. They are integrally incorporated as a unit, and are placed in a cartridge shell C. The main assembly of the image forming apparatus in which the process cartridge is to be installed comprises means (unillustrated) for allowing the process cartridge to be easily installed into, or removed from, the image forming apparatus.

The charge roller 2 in this embodiment is the same as the one described in Embodiment 1.

In the development apparatus 4, a reference numeral 42 designates a development sleeve; 43, a container for storing the toner 41; and 44 designates a development blade for coating the toner 41 on the development sleeve 42 to a uniform thickness.

In the cleaning apparatus 5, a reference numeral 51 designates a cleaning blade, and 52 designates a toner dump in which the toner 41 recovered by the cleaning blade 51 is collected.

A reference numeral 12 designates a drum shutter of the process cartridge. It is movable between the closed position illustrated by a solid line, and the open position illustrated by a dotted line. When the process cartridge is outside the main assembly of the image forming apparatus, the drum shutter 12 is in the closed state illustrated by the solid line, covering the otherwise exposed surface portion of the photosensitive drum 1 to protect it.

When the process cartridge is in the image forming apparatus, the drum shutter 12 must be open as depicted by the dotted line; it may be a manual shutter which is opened before the installation of the process cartridge, or it may be an automatic one which is automatically opened as the process cartridge is installed into the image forming apparatus. As the process cartridge is correctly installed, the exposed surface portion of the photosensitive drum 1 comes in contact with the transfer roller 10 (transfer apparatus in FIG. 1) of the main assembly of the image forming apparatus.

At the same time, the process cartridge and the apparatus main assembly are coupled with each other, mechanically and electrically, enabling the photosensitive drum 1, the development sleeve 42, and the like, of the process cartridge to be driven by the driving mechanism provided on the apparatus main assembly side, and also enabling the charging bias and the developing bias to be applied to the charge roller 2 and the development sleeve 42, respectively, of the process cartridge from the electrical circuits provided on the apparatus main assembly side. In other words, the image forming apparatus becomes ready for an image forming operation.

A reference numeral 13 designates an exposure window provided in the process cartridge, between the cleaning apparatus 5 and the development apparatus 4. The laser beam 33 emitted from the laser scanner (unillustrated) of the apparatus main assembly enters the process cartridge through this exposure window 13 to scan, that is, expose, the surface of the photosensitive drum 1.

Also in this embodiment, the main assembly of the image forming apparatus is provided with the same charging current detecting means 7 as the one described in Embodiment 1.

With the structure described above in place, the level of the charging current is detected following the timing sequence given in FIG. 4. First, the primary bias is turned on, and the end and middle portions of the photosensitive drum 1 are exposed by the laser scanner. Then, while these exposed portions are recharged, the level of the, current slowing into the photosensitive drum 1 from the bias power source 6 is measured by the charging current detecting means 7 to compute the difference in the photosensitive layer thickness of the photosensitive drum 1 between the end and middle portions, from which the residual service life of the photosensitive drum 1 in the process cartridge can be accurately predicted, making it possible to know the exact time at which the process cartridge is to be exchanged. It should be noted here that the bias power source 6 and the charging current detecting means 7 are not illustrated in FIG. 5.

Embodiment 3

Also in this embodiment, a process cartridge is employed in the image forming apparatus comprising the residual photosensitive member service life detection apparatus 7 described in Embodiment 1. However, the process cartridge in this embodiment, which is also constituted of a processing unit integrally comprising the photosensitive drum 1 and the development apparatus 4, is different in that when the development apparatus 4 is depleted of toner, it can be replenished with fresh toner.

Figure 6:
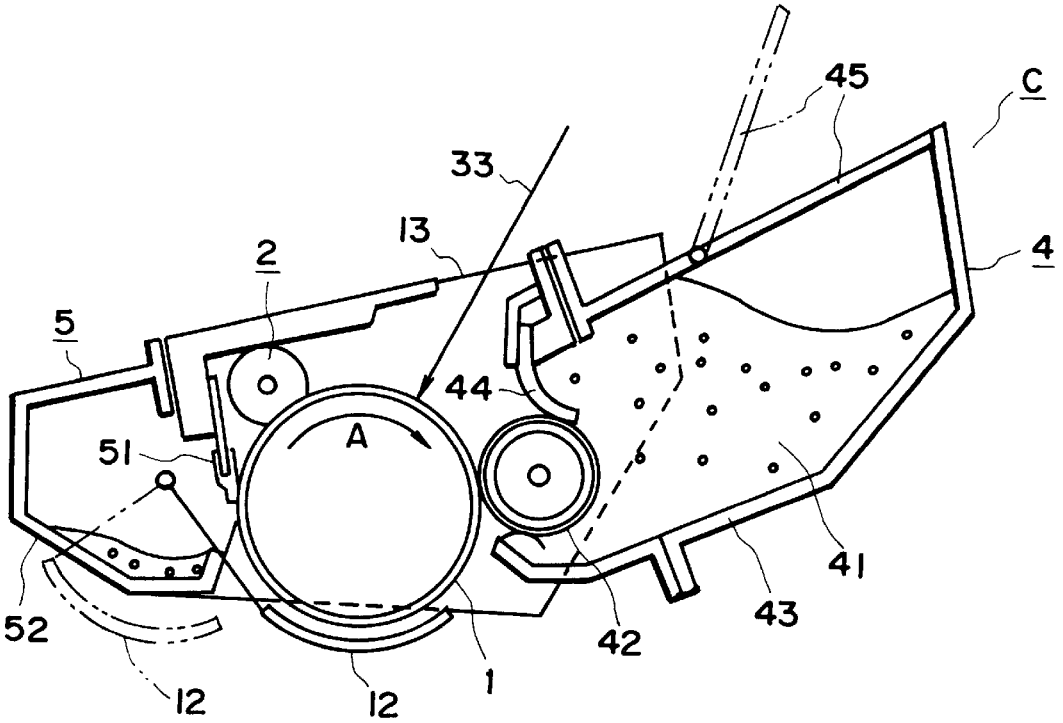
FIG. 6 is a longitudinal section of the process cartridge in the third embodiment of the present invention.
Figure 7:
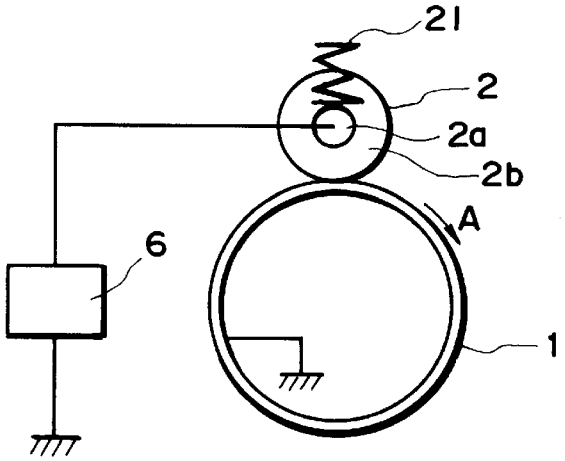
FIG. 7 is a longitudinal section depicting the photosensitive drum and the charging apparatus in a conventional image forming apparatus.

Referring to FIG. 6, the process cartridge in this embodiment is provided with a toner replenishment lid 45, which is placed on the toner storage container 43 of the development apparatus 4, allowing the toner depleted development apparatus 4 to be replenished with the toner. The other portions of the process cartridge are the same as those described in Embodiment 2; therefore, their descriptions will be excluded.

The structure of the main assembly of the image forming apparatus in this embodiment is also the same as that described in Embodiment 2. The difference in the photosensitive layer thickness between the end and middle portions of the photosensitive drum 1 is detected also following the timing sequence given in FIG. 4.

With the above described arrangement in place, the residual service life of the photosensitive drum 1 in the process cartridge 1 can be accurately known: therefore, the problem of wasting the toner by replenishing the toner immediately before the service life of the photosensitive drum 1 expires can be eliminated.

Embodiment 4

The characteristic of this embodiment is that the intensity of the exposure light emitted for detecting the photosensitive layer thickness is rendered greater than that for exposing the photosensitive layer to form an image.

This arrangement will be described referring to the image forming apparatus described in Embodiment 1.

Also in this embodiment, the difference in the photosensitive layer thickness between the end and middle portions of the photosensitive drum 1 is detected also following the timing sequence given in FIG. 4.

First, the primary bias is turned on to uniformly charge the surface of the photosensitive drum 1 to approximately −700 V. Then, the photosensitive drum 1 is exposed by the exposure apparatus 3 as illustrated in FIG. 2, that is, only on one of the end portions with which the Correspondent end portions of the charge roller 2 are in contact (region between points 3*a* and 3*b* in FIG. 2).

Next, the photosensitive drum 1 is exposed as illustrated in FIG. 3, that is only on the middle portion (region between points 3*d* and 3*e* in FIG. 3) which is in contact with the middle portion of the charge roller 2. The exposure light intensity at this time is set at 1.5 times the light intensity for the image exposure. As a result, the surface potential levels of both exposed regions of the photosensitive drum 1 reach approximately −50 v (in the case of the light intensity for the normal image exposure, the surface potential level of the exposed region reaches approximately −100 V).

Next, while the aforementioned exposed end and middle portions are recharged as the photosensitive drum 1 is further rotated, the current flowing from the bias power source 6 into the photosensitive drum 1 is measured by the charging current detecting means 7.

Then, the residual service life of the photosensitive drum 1 is predicted on the basis of the difference in the detected current value between the end and middle portions.

According to this embodiment, the intensity of the exposure light for detecting the photosensitive layer thickness is rendered greater than that for the image exposure, allowing the surface potential of the photosensitive drum 1 to attenuate to a lower value than those in the preceding embodiment. Therefore, the charging current which flows when the exposed portions are recharged can be increased. As a result, it becomes easier to detect the difference between the currents detected at the end and middle portions.

As described above, the photosensitive member service life detection apparatus exposes the photosensitive member charged by the contact type charging member, across the end and middle portions, and compares the currents which flow from the power source to the exposed end and middle portions through the contact type charging member when the exposed end and middle portions are recharged, respectively. The thickness of the photosensitive layer can be detected on the basis of this comparison. Therefore, the residual service life of the photosensitive member can be accurately predicted.

Also in the case of the image forming apparatus employing the replaceable process cartridge which integrally comprises a minimum of the photosensitive member as the image bearing member, the precise timing for replacing the process cartridge can be known by accurately predicting the residual service life of the photosensitive member with the provision of the aforementioned photosensitive member service life detection apparatus.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus, comprising:

an image bearing member;

a charging member contactable to said image bearing member for charging said image bearing member at a charging position, said charging member being supplied with a voltage;

a discharging member for electrically discharging said image bearing member, said discharging member discharging a first region of said image bearing member corresponding to a central Portion of said charging member in a longitudinal direction of said charging member, and a second region of said image bearing member corresponding to an end portion of said charging member in the longitudinal direction of the charging member;

detecting means for detecting a current flowing through said charging member when said charging member is supplied with a predetermined voltage and the first region having been discharged by said discharging member passes through said charging position, and when said charging member is supplied with the predetermined voltage and the second region having been discharged by said discharging member passes through said charging position.

2. An apparatus according to claim 1, wherein said image bearing member is an electrophotographic photosensitive member, and said discharging member exposes said photosensitive member to light.

3. An apparatus according to claim 1, wherein said first region and second region are not overlapped.

4. An apparatus according to claim 1, further comprising a process cartridge detachably mountable to a main assembly of an image forming apparatus, wherein said process cartridge contains said image bearing member and means actable on said image bearing member to form an image on said image bearing member.

5. An apparatus according to claim 1, further comprising a process cartridge detachably mountable to a main assembly of an image forming apparatus, wherein said process cartridge contains said image bearing member and said charging member.

6. An apparatus according to any one of claims 1–5, wherein a service life of said image bearing member is discriminated on the basis of an output of said detecting means.

7. An apparatus according to any one of claims 1 or 3–5, wherein said image bearing member is an electrophotographic photosensitive member.

8. An image forming apparatus, comprising:

a charging member contactable to an image bearing member for charging the image bearing member at a charging position, said charging member being supplied with a voltage;

a discharging member for electrically discharging the image bearing member, said discharging member discharging a longitudinal end region of the image bearing member without discharging a longitudinal central portion of said image bearing member;

detecting means for detecting a current flowing through said charging member when said charging member is supplied with a predetermined voltage and the end region having been discharged by said discharging member passes through said charging position.

9. An apparatus according to claim 8, wherein said image bearing member is an electrophotographic photosensitive member, and said discharging member exposes said photosensitive member to light.

10. An apparatus according to claim 8, wherein said end portion is a longitudinal end portion of the image bearing member.

11. An apparatus according to claim 8, further comprising a process cartridge detachably mountable to a main assembly of an image forming apparatus, wherein said process cartridge contains said image bearing member and means actable on said image bearing member to form an image on said image bearing member.

12. An apparatus according to claim 8, further comprising a process cartridge detachably mountable to a main assembly of an image forming apparatus, wherein said process cartridge contains said image bearing member and said charging member.

13. An apparatus according to any one of claims 8–12, wherein a service life of said image bearing member is discriminated on the basis of an output of said detecting means.

14. An apparatus according to any one of claims 8 or 10–12, wherein said image bearing member is an electrophotographic photosensitive member.

* * * * *

UNITED STATES PATENT AND TRADEMARK OFFICE

CERTIFICATE OF CORRECTION

PATENT NO. : 5,805,951

DATED : September 8, 1998

INVENTORS : JUNICHI KATO, ET AL.

It is certified that error appears in the above-identified patent and that said Letters Patent is hereby corrected as shown below:

COLUMN 2,
Line 13, "surf ac e" should read --surface--;
Line 17, "be" should read --be- --; and
Line 18, "likewise ." should read --likewise.--.

COLUMN 3,
Line 23, "must," should read --must--;
Line 45, "one" should read --one of--; and
Line 50, "Liming" should read --timing--.

COLUMN 5,
Line 13, "Photosensitive" should read --photosensitive--; and
Line 28, "the" should read --The--.

COLUMN 6,
Line 19, "period.," should read --period,--; and
Line 40, "layer" should read --layer.--.

COLUMN 7,
Line 24, "like" should read --like.--; and
Line 30, "In" should read --in--.

UNITED STATES PATENT AND TRADEMARK OFFICE

CERTIFICATE OF CORRECTION

PATENT NO. : 5,805,951

DATED : September 8, 1998

INVENTOR(S) : JUNICHI KATO, ET AL.

It is certified that error appears in the above-identified patent and that said Letters Patent is hereby corrected as shown below:

COLUMN 8,
Line 32, "the," should read --the--; and
Line 33, "slowing" should read --flowing--.

COLUMN 9,
Line 3, "known:" should read --known;--;
Line 22, "Correspondent" should read --correspondent--; and
Line 32, "-50v" should read -- -50V--.

COLUMN 10,
Line 20, "Portion" should read --portion--;
Line 25, "member;" should read --member; and--; and
Line 56, "or" should read --and--.

COLUMN 11,
Line 2, "member;" should read --member; and--.

COLUMN 12,
Line 13, "or" should read --and--.

Signed and Sealed this

Thirtieth Day of March, 1999

*Attest:*

*Attesting Officer*

Q. TODD DICKINSON

*Acting Commissioner of Patents and Trademarks*